US005600396A

United States Patent [19]

Biegler et al.

[11] Patent Number: 5,600,396

[45] Date of Patent: Feb. 4, 1997

[54] PHOTOTHERMOGRAPHIC THERMAL PROCESSOR FILTRATION SYSTEM

[75] Inventors: Robert M. Biegler, Woodbury; Rosanne E. Gronseth, Minneapolis; Robert J. Ryther, St. Paul; Michael P. Juaire, Maple Grove; John A. Svendsen, Marine on St. Croix, all of Minn.

[73] Assignee: Imation Corp., St. Paul, Minn.

[21] Appl. No.: 566,931

[22] Filed: Dec. 4, 1995

Related U.S. Application Data

[63] Continuation-in-part of Ser. No. 239,888, May 9, 1994, Pat. No. 5,510,871.

[51] Int. Cl.[6] ..... G03D 7/00

[52] U.S. Cl. ..... 396/565; 396/575; 396/579

[58] Field of Search ..... 354/300; 34/630; 430/350, 356; 128/206.12, 205.27; 55/387, 316, 70; 210/496; 219/121 LC, 216

[56] References Cited

U.S. PATENT DOCUMENTS

| | | | |
|---|---|---|---|
| 3,457,075 | 7/1969 | Morgan et al. | 430/350 |
| 3,538,020 | 11/1970 | Heskett et al. | 210/496 |
| 3,570,383 | 3/1971 | Berg | 354/300 |
| 3,721,072 | 3/1973 | Clapham | 55/387 |
| 4,059,409 | 11/1977 | Barto et al. | 354/300 X |
| 4,473,282 | 9/1984 | Michlin | 354/300 |
| 4,518,843 | 5/1985 | Antol et al. | 219/121 LC |
| 5,033,465 | 7/1991 | Braun et al. | 128/205.27 |
| 5,047,798 | 9/1991 | Yamamoto et al. | 219/216 |
| 5,078,132 | 1/1992 | Braun et al. | 128/206.12 |

FOREIGN PATENT DOCUMENTS

0373932A3 6/1990 European Pat. Off. .

OTHER PUBLICATIONS

U.S. patent application Ser. No. 07/942,633 filed Sep. 9, 1992.

U.S. patent application Ser. No. 08/239,709 filed May 9, 1994.

Illustrated parts manual for 3M brand Model 259B Continuous Thermal Processor.

*Primary Examiner*—D. Rutledge

*Attorney, Agent, or Firm*—Mark A. Litman

[57] ABSTRACT

A thermal developing unit for the thermal development of photothermographic media which comprises a means for thermally developing photothermographic media by placing said media in contact with a heated element within a case, a first and second opening for venting gas from said case, said first opening being connected to an area surrounding said heated element said second opening being connected to an area within said unit where said media passes after it has been thermally developed, and in a path by which said gas can be vented through at least one of said first or second openings from said case there is a filter cartridge comprising a filter housing containing a chemical filtration media having no bonded absorbent partculates therein.

13 Claims, 1 Drawing Sheet

PHOTOTHERMOGRAPHIC THERMAL PROCESSOR FILTRATION SYSTEM

This application is a continuation-in-part of U.S. application Ser. No. 08/239,888 filed on May 9, 1994 now U.S. Pat. No. 5,510,871.

BACKGROUND OF THE ART

1. Field of the Invention

The present invention relates to apparatus used for the thermal development of photothermographic media. In particular, the present invention relates to a filter for use in such thermal development apparatus.

2. Background of the Invention

Thermographic and photothermographic imaging systems based on the generation of silver images by the thermally induced reduction of silver salts are well known in the art. A silver image is generated by the localized (imagewise distributed) reduction of a silver salt, ordinarily the reduction an organic, low-light sensitivity or light insensitive organic silver salt (usually refered to as a light insensitive silver salt) by a reducing agent for silver ion. In a thermographic system, the differentiation between the image and the background is controlled by imagewise distribution of heat, with the silver image being formed where heat is applied. In a photothermographic system, a light sensitive silver salt (i.e., silver halide) is placed in catalytic proximity to the light insensitive silver salt. When the silver halide is struck by radiation to which it is sensitive or has been spectrally sensitized, metallic silver (unoxidized silver, Ag°) is photolytically formed. The photolytically formed silver acts as a catalyst for the further reduction of silver salt, including the light insensitive silver salt in catalytic proximity to the silver halide. Upon heating of the radiation exposed photothermographic element, the light insensitive silver salt in catalytic proximity to silver halide having developable silver specks thereon are more rapidly reduced by reducing agent which is present around the silver materials. This causes the silver image to be primarily formed where the photothermographic element was irradiated.

The most common type of photothermographic element which is commercially available comprises a silver halide as the light sensitive silver salt (either as in situ formed silver halide or preformed silver halide), a silver salt of an organic acid (usually a salt of a long chain fatty acid (e.g., having carbon lengths of 14 to 30 carbon atoms, such as behenic acid)) as the light insensitive silver salt, a photographic silver halide developer or other weak reducing agent as the reducing agent for silver ion, and a binder to hold the active ingredients together in one or two layers (e.g., U.S. Pat. No. 3,457,075).

Development usually occurs by placing the exposed photothermographic element in contact with a heated surface (e.g., a heated roller or platen) or in an inert heated fluid bath. The heated rollers used in the past have generally been fairly open to the environment which has enabled any innocuos materials generated or evaporated by the heating step to harmlessly escape to the atmosphere. Newer types of imaging systems sometimes desire more closed work areas or completely closed systems which do not have ready venting to the atmosphere. It would be a severe limitation on thermal developing units for use with photothermographic elements, if they were to be part of a more closed system, to require a dedicated venting or exhaust system for evaporated materials.

Commercial models of thermal processors for photothermographic elements, such as the 3M Model 259B Continuous Thermal Processor have contained some filtering means on the equipment. In that particular processor, the filtering means is separated from the actual thermal development area of the processor as shown in the Illustrated Pans Manual for that processor.

It has been found by the inventors that thermal development of photothermographic elements in a closed imaging unit allows for certain harmless materials evaporated during the thermal development step to deposit on the interior of the unit. This condensation of materials (e.g., such as the free fatty acid generated upon reduction of the silver salt and then evaporated during development) can adversely affect many aspects of the imaging process. The condensation may clog vents and cause the developer unit to overheat. The condensate may deposit on the heating element and cause localized insulation of the heated surface in a random fashion, producing image variations across the imaged element. The condensate may deposit on imaging media or on seams of the unit and cause an unsightly appearance or leave greasy materials on the hands of anyone using the unit. It was necessary to find a means of removing the evaporated materials from the vent stream without the need of a dedicated vent (e.g., a vent that accesses the exterior of a room or building or a special ducted vent stream within a building).

SUMMARY OF THE INVENTION

A filter medium containing bonded gas absorbent particulates, such as bonded carbon, is used in a vent stream from a thermal developer unit for photothermographic media to remove material from the vent stream. Some of these removed materials can condense after cooling to temperatures below the thermal development temperature and undesirably deposit themselves in or on the apparatus. A filter comprising a material which reacts with or coordinates aldehydes (e.g., butyraldehyde) offers the additional advantage of removing odors from the thermal developer apparatus. These materials do not have to be bonded particulate materials.

Venting of the emissions from the thermally developed photothermographic element at multiple locations within the housing of a thermal processor has been found to be desirable, independent of the type of filter used in cleansing the gas stream from the processor.

DETAILED DESCRIPTION OF THE INVENTION

Figure 1:
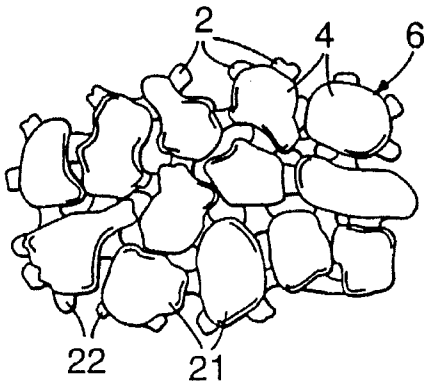
FIG. 1 shows an illustration and greatly enlarged fragmentary view of a single layer of bonded absorbent filter material.

It has been generally found in the past construction of thermal developing units for photothermographic systems that a cylindrical heating element offers the best performance and compactness in a developer unit. Such cylindrical developing units are shown for example in U.S. Pat. No. 4,518,843 and U.S. patent application Ser. Nos. 08/239,709, and 07/942,633.

When it was attempted to merely place these commercial thermal developing units into an enclosed imaging/developing system, problems were immediately encountered with deposition of materials evaporated from the thermally developed media. The problems with deposited materials occurred within and outside of the enclosed apparatus. It was also noted that with certain photothermographic media, trace solvents were also evaporated which, within the confined space of the apparatus or a small room, could cause a significant odor. The source of the odor appeared to be aldehydes, and particularly butyraldehyde from within the photothermographic media.

It was also found during initial efforts to remove the effluents that were depositing within the housing that the number and location of vents streams within the processor were important. In particular it was found that merely placing vent(s) within the segment of the processor where the thermal development drum or platen was located would not remove sufficient amounts of the effluent to provide long term protection of the apparatus. It was a determined that in addition to materials being vaporized on the thermal drum or platen itself, the photothermographic element was still sufficiently hot after removal from the drum and during transportation of the developed media to an external port for delivery to the user that significant amounts of effluent were still coming off the media. To assure that the internal areas of the processor were protected from all sources of volatiles that could redeposit within the processor, it was found that at least two separate venting areas were necessary within the processor. One vent could be located above the thermal drum or platen (as heat rises, it is easier to provide the vent at a location to where the heated gases rise, even when reduced pressure was used to facilitate the venting). The vent intended to collect the vapors from the heating drum does not have to be located directly above the drum, particularly when it is assisted by reduced pressure to enhance the flow of gases into the vent stream. It is desirable to have the vent above the center of mass of the drum, at least as a convenience, however. The second vent may also be located within the portion of the processor housing the heating roller or drum, but should be located where it is closer to the stripping point of the media and the drum (the point at which the media and the drum separate from each other so that there is no longer any thermal conduction between the drum and the media. The vent associated with the splitting or separation point on the drum may be located above or to the side or just below that point on the exterior direction within the housing. The use of reduced pressure (e.g., exhaust fan or pump) will facilitate removal of the vapors here, just as it does with the vent 'above' the heating drum.

Numerous commercial filter materials were evaluated. Only chemical filtration media were found to be worthwhile in the practice of the present invention. Chemical filtration media are materials which are capable of binding, bonding, reacting with, or otherwise fixing individual chemical molecules. This is in comparison with the previous filter materials used in the Model 259B Continuous Thermal Processor which were merely metal surfaces upon which evaporated materials could condense. Chemical filtration media include activated carbon or zeolite, granulated particulates of such chemically active materials, foams or webs which contain such chemical filtration materials, porous polymers (as fibers or particulates or foams, and the like. Although the bonded particulates have proven to be the best from a number of standpoints, non-bonded particulate media as herein described can be used with the potential sacrifice of reduced efficiency levels, less convenient packaging, or shorter lifecycles as filters. Media of these chemical filtration media would be used in similar locations to the locations of the bonded particulate media. They could be located with direct venting from the thermal developer unit (e.g., attached directly to the housing), or in a vent stream removed from the housing (e.g., the thermal developing unit and the filter being separated by walls of the housing, duct work, intermediate filters, or the like). These type of chemical filtration materials are well described in the art and are commercially available. The materials should be selected on the basis of their ability to chemically absorb low molecular weight organic materials (e.g., molecular weights lower than 500, such as butyraldehyde, methylethylketone, toluene, etc.) as well as being able to accept the condensation or molecular absorption of organic fatty acids of 12 to 30 carbon atoms.

Bonded absorbent particulate filter media are described for example in U.S. Pat. Nos. 5,033,465 and 5,078,132. The bonded filter media may be described as spaced absorbent granules or particles which are bonded to one another by adherent binder particles distributed between the absorbent granules. The binder particles do not form a continuous phase surrounding the absorbent particles, but allow for gases to move throughout the bonded structure. The binder particles are preferably very evenly distributed throughout the bonded structure and around the absorbent granules to provide uniformity to the flow characteristics of the bonded filter medium. Where particular absorption characteristics are desired in the bonded filter medium, the binder particles may be comprised of a polymer which has particularly desired chemically reactive or chelating sites in or pendant from the polymer chain.

The prefered absorbent particles are carbon, and particularly activated carbon granules. Any thermally softenable particulate binder can be used as the binder particle, but polyolefins, nylons, and polyurethanes are preferred. Mixtures of polymeric binder particles may also be used to tailor the structural and absorbence characteristics of the filter media.

The bonded filter material provides compactness to the filter element, which is important to its use in a unitary exposure/development apparatus for photothermography. The filter material can be molded into a form that can be inserted into a filter support device. The filter support device can be fixed to the development apparatus or removable therefrom. The filter can be replaceable in the filter support, or the filter support can be disposable.

Figure 2:
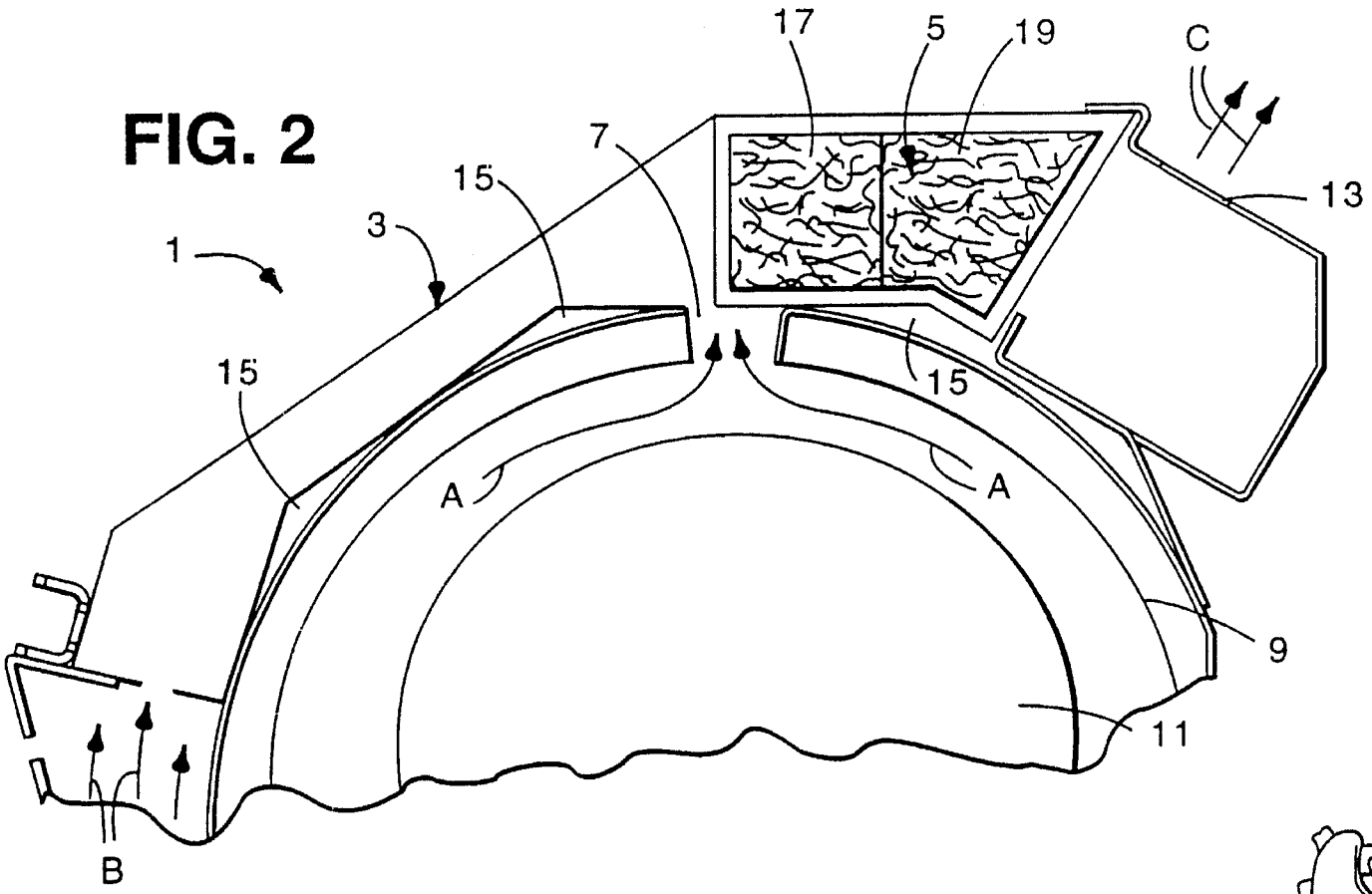
FIG. 2 shows a side view of a molded filter element for use in the present invention.

FIG. 2 shows a side view of a molded filter element (or filter cartridge) 1 comprising a filter support 3 housing a filter unit 5. The filter element 1 is placed in a position to receive gas flow from both a first vent stream (indicated by arrows A) coming out of gaps 7 in a frame 9 surrounding a cylindrical heating element 11 and a second vent stream (indicated by arrows B) coming out of the interior of the development unit (not shown). A filtered vented stream (indicated by arrows C) exit an opening 13 in the cartridge 1 alter passing through the filter unit 5. The molded filter cartridge 1 is shown to be placed in contact with the frame 9 of the thermal developer unit (not shown in its entirety). Areas 15 where there is no contact between the cartridge 1 and the frame 9 are shown. These areas 15 provide thermal insulation between the frame 9 and the filter cartridge 1. This is not essential, but is a preferred embodiment of the practice of the invention. Likewise, venting from the area where photothermographic media is thermally developed is essential, but venting from other areas is only preferred. The developing unit may have a filter housing which contains first and second openings into which gas is vented, the first opening connected to an area surrounding the space within the developer unit where a heated element thermally develops the photothermographic media. The developing unit may also contain a second opening connected to an area within said unit where media passes alter it has be thermally developed. This second opening for venting gas towards the filter may be connected to the area where film leaves the developer unit immediaterly alter thermal development. As the media may be very warm at this point, gas (e.g., evaporated materials) may still be leaving the surface of the media and it is desirable to remove such materials at every available opportunity.

As previously noted, the filter material itself may be composed of any chemical filtration material or may comprise two different types of bonded or unbonded materials. The two materials may be combined by either mixing the various filtering and reactive materials together into a well distributed mixture, forming a two or more layered filter element with the various filtering activities distributed in distinct layers, or by making two distinct filter materials which are placed next to each other within the filter cartridge. In FIG. 2, two distinct layers of filter materials 17 and 19 are shown distributed along the path of flow from within the frame 9 to the exit opening lit. The order of the filtering materials is not important.

Activated carbon particles, chemical filtration materials and zeolites are commercially available and are generally designated in the art by their absorptive characteristics with respect to specific types of materials. For example, activated charcoal is commercially available from suppliers under designations such as "Formaldehyde Sorbent," "Organic vapor Sorbent," "Acid gas Sorbent," and "Organic Vapor/Acid Gas Sorbent." In general, any carbon filter material may be used in the practice of the present invention, with various levels of benefits over many other commercially available filter materials. However, the activated carbon particles, and most especially the Organic Vapor/Acid Gas Sorbent types of activated carbon particles are preferred. Filters made from bonded absorbent particles, and particularly bonded carbon, were found to be much better filter materials for vent streams from photothermographic developing units as compared to fiber glass, ceramic fibers, polyester fiber, and open-celled foams. The bonded absorbent particulate fibers used in the practice of the present invention showed more uniform absorption of material throughout the body of the filter (reducing channelling and clogging of the filter cartridge), greater absorption capacity, and the ability to absorb a more diverse range of materials exiting the thermal developer unit.

The materials selected for the construction of the frame, cartridge, etc. are not critical. Any material which can be formed into the appropriate shape with meaningful structural properties can be used. It is prefered to use metals, polymeric materials, composites or the like for the construction of these parts of the equipment.

What is claimed:

1. A thermal developing unit for the thermal development of photothermographic media which comprises a means for thermally developing photothermographic media by placing said media in contact with a heated element within a case, a first and second opening for venting gas from said case, said first opening being connected to an area surrounding said heated element said second opening being connected to an area within said unit where said media passes after it has been thermally developed, and in a path by which said gas can be vented through at least one of said first or second openings from said case there is a filter cartridge comprising a filter housing containing a chemical filtration media having no bonded absorbent partculates therein.

2. The developing unit of claim 1 wherein said filter housing contains a first and second openings into which gas is vented, said first opening connected to an area surrounding said heated element.

3. A thermal developing unit for the thermal development of photothermographic media which comprises a means for thermally developing photothermographic media in contact with a heated element within a case, an opening for venting gas from said case, and a cartridge in a path by which said gas may be vented from said opening from said case, wherein said cartridge is in venting contact said case which houses said heated element, said cartridge containing a chemical filtration material other than bonded particulates.

4. The developing unit of claim 3 wherein said contact leaves insulating spaces between said cartridge and said frame.

5. The developing unit of claim 3 wherein said contact leaves insulating spaces between said cartridge and said frame.

6. The developing unit of claim 3 wherein said contact has an insulating layer of material between said cartridge and said frame.

7. A process for thermally developing a photothermographic media within an enclosed processor comprising the steps of transporting a photothermographic element with a latent image thereon to a thermal heating element comprising a drum, placing said photothermographic media with a latent image into contact with said drum, heating said photothermographic media with a latent image thereon with said drum to generate a photothermographic media with a visible image thereon, then removing said media with a visible image thereon, said process comprising venting a gas stream from at least area area within said processor, said at least one area selected from the group consisting of a) a vent at a position above the axis of the heating drum, and b) a vent at a position sufficiently near a point on the drum where the photothermographic media with a visible image thereon is removed from the drum so that at least some vapor material leaving said photothermographic media with a visible image thereon exits through said vent and passes into a chemical filtration media having no bonded absorbent particulates therein.

8. The process of claim 7 wherein reduced pressure is used in at least one of said vents to draw gas into said at least one vent.

9. The process of claim 7 wherein both organic fatty acids and organic materials with a molecular weight less than 500 are filtered out of said gas stream.

10. The process of claim 8 wherein both organic fatty acids and organic materials with a molecular weight less than 500 are filtered out of said gas stream.

11. The process of claim 10 wherein said organic materials comprise at least one compound selected from the group consisting of butyraldehydes, methanol, ethanol, acetic acid, acetone, methylethylketone, and toluene.

12. The process of claim 9 wherein said organic materials comprise at least one compound selected from the group consisting of butyraldehydes, methanol, ethanol, acetic acid, acetone, methylethylketone, and toluene.

13. The process of claim 9 where the organic fatty acids are captured through absorption rather than by condensation.

* * * * *

UNITED STATES PATENT AND TRADEMARK OFFICE

CERTIFICATE OF CORRECTION

PATENT NO.: 5,600,396

DATED: February 4, 1997

INVENTOR(S): Biegler et al.

It is certified that errors appear in the above-identified patent and that said Letters Patent is hereby corrected as shown below:

First page, second column, last line of ABSTRACT, "partculates" should be --particulates--.

Col. 1, line 59, "innocuos" should be --innocuous--.

Col. 2, line 6, "Pans" should be --Parts--.

Col. 3, line 15, "vents streams" should be --vent streams--.

Col. 3, line 20, "was a determined" should be --was determined--.

Col. 5, line 7, "alter it has be thermally" should be --after it has been thermally--.

Col. 5, line 10, "immediaterly alter" should be -- immediately after--.

Col. 6, line 4, "partculates" should be --particulates--.

Col. 6, line 6, "openings" should be --opening--.

Col. 6, line 15, "contact said" should be --contact with said--.

UNITED STATES PATENT AND TRADEMARK OFFICE

CERTIFICATE OF CORRECTION

PATENT NO. : 5,600,396

DATED : February 4, 1997

INVENTOR(S) : Biegler et al.

It is certified that error appears in the above-identified patent and that said Letters Patent is hereby corrected as shown below:

Col. 6, lines 21-23, Cancel claim 5 as it is a duplicate of claim 4.

Col. 6, line 37, "least area area" should be –least one area–.

Signed and Sealed this

Sixteenth Day of December, 1997

Bruce Lehman

*Attest:*

BRUCE LEHMAN

*Attesting Officer*

*Commissioner of Patents and Trademarks*